US005361086A

United States Patent [19]

Tagashira

[11] Patent Number: 5,361,086

[45] Date of Patent: Nov. 1, 1994

[54] DIVISIONAL-TYPE THERMAL PRINTHEAD

[75] Inventor: Fumiaki Tagashira, Kyoto, Japan

[73] Assignee: Rohm Co., Ltd., Kyoto, Japan

[21] Appl. No.: 40,469

[22] Filed: Mar. 22, 1993

[30] Foreign Application Priority Data

Mar. 27, 1992 [JP] Japan ..... 4-070984

[51] Int. Cl.[5] ..... B41J 2/335

[52] U.S. Cl. ..... 346/76 PH

[58] Field of Search ..... 346/76 PH; 400/120

[56] References Cited

U.S. PATENT DOCUMENTS 5,028,935 7/1991 Warmack et al. ..... 346/76 PH 5,148,188 9/1992 Ota et al. ..... 346/76 PH

FOREIGN PATENT DOCUMENTS 0212157 8/1990 Japan ..... 346/76 PH 4-52149 2/1992 Japan .

*Primary Examiner*—Benjamin R. Fuller

*Assistant Examiner*—Huan Tran

*Attorney, Agent, or Firm*—William H. Eilberg

[57] ABSTRACT

A divisional-type thermal printhead comprises an insulating base board, and a plurality of unit substrates arranged in series on the base board. The unit substrates have their respective common electrodes in electrical independence of each other. Further, the base board is formed with a plurality of conductor films extending under the respective unit substrates in corresponding relation thereto, and each of the conductor films is electrically independent of the other conductor films but electrically connected to the common electrode of a corresponding unit substrate.

7 Claims, 3 Drawing Sheets

DIVISIONAL-TYPE THERMAL PRINTHEAD

BACKGROUND OF THE INVENTION

1. Field of the Invention

This invention relates generally to thermal printheads which are used in facsimile machines and various printers. More specifically, the present invention relates to a thermal printhead of the type which comprises a plurality of unit substrates arranged in series on a base board for providing an increased printing width.

2. Description of the Prior Art

As is well known, thermal printheads are widely used to print information on papers of various sizes. Thus, the length of the printhead (namely, the printing width) must be adjusted to suit the particular paper size to which the printhead is applied.

However, if the paper size is too large, it becomes difficult or impractical to increase the length of a single thermal printhead to suit the excessively large paper size such as JIS-A2 (JIS: Japanese Industrial Standards) or larger paper size. Further, it is technically disadvantageous to provide thermal heads of various sizes due to the necessity of redesigning upon every change in size.

On the other hand, for enabling a printing operation of a thermal printhead, a drive current is made to pass through a common electrode which is connected commonly to a multiplicity Of heating dots (divided portions of a linear heating resistor). Thus, if the printhead (namely, the common electrode) is rendered long for adaptation to a large paper size, a problem of voltage drop will arise with respect to those heating dots located far from the power supplying point or points of the common electrode due to the inherent resistivity of the common electrode, consequently resulting in a deterioration of the printing quality.

In view of the above problems, Japanese Patent Application Laid-open No. 4–52149 (Laid-open: Feb. 20, 1992) of the same inventor proposes a thermal printhead which overcomes both of the problems described above.

More specifically, the prior art thermal printhead disclosed in the above Japanese document comprises a plurality of unit substrates arranged in series on a common base board. The unit substrates carry their respective heating resistors aligned in a single straight line, and their respective common electrodes extending along the line of heating resistors. Further, the base board carries a passage widening conductor strip which is electrically connected to the common electrodes of the respective unit substrates and to a single power source.

The above-described thermal printhead is called "divisional-type thermal printhead" due to the use of plural unit substrates. In such a printhead, the overall printing width can be optionally adjusted by selecting the number of unit substrates without changing the length of each unit substrate itself. Further, the passage widening conductor strip formed on the base board reduces the voltage drop along the common electrodes of the respective unit substrates, thereby preventing a deterioration (unevenness) of the printing quality which would result from such a voltage drop.

However, the divisional-type thermal printhead described above is still unsatisfactory for the following reasons.

In the prior art divisional-type thermal printhead, the passage widening conductor strip is used commonly for the common electrodes of the respective unit substrates.

Thus, the respective common electrodes of the unit substrates are held at a constant voltage level because there is substantially no voltage drop along the passage widening conductor strip.

However, it is difficult to equalize the resistivity characteristics with respect to the heating resistors of the respective unit substrates due to inevitable manufacturing variations. Particularly, the resistivity characteristics tend to vary more greatly between different lots than in a same lot. Further, the resistivity characteristics variation is more pronounced when the heating resistor is formed by a thin-film printing method than when it is formed by a thick-film printing method.

If a same voltage is applied to the heating resistors (namely, the common electrodes) of the respective unit substrates which have different resistivity characteristics, it is impossible to equalize the printing quality between the respective heating resistors. Thus, in the prior art printhead, it is only possible to equalize the printing quality within each heating resistor due to the function of the passage widening conductor strip, and such a function of the passage widening conductor strip gives rise to a new problem of printing quality inequality between the different unit substrates.

It is conceivable to select plural unit substrates of a uniform resistivity characteristics before incorporation into the printhead, thereby equalizing the printing quality along the entire length of the printhead. However, this solution is impractical in that the selection of unit substrates is troublesome and requires discarding of those unit substrates which are outside an acceptable limit, thus resulting in a cost increase.

SUMMARY OF THE INVENTION

It is, therefore, an object of the present invention to provide a divisional-type thermal printhead which is capable of equalizing the printing quality longitudinally over the combined length of plural unit substrates and within each unit substrate.

According to the present invention, there is provided a divisional-type thermal printhead comprising: an insulating base board means; and a plurality of unit substrates arranged in series on the base board means, each of the unit substrates having a heating resistor means extending substantially straight along an edge of the unit substrate and a common electrode extending between the heating resistor means and said edge; wherein the common electrodes of the respective unit substrates are electrically independent of each other; and wherein the base board means is formed with a plurality of conductor film means extending under the respective unit substrates in corresponding relation thereto, each of the conductor film means being electrically independent of the other conductor film means but electrically connected to the common electrode of a corresponding unit substrate.

In a preferred embodiment, each of the conductor film means has a first exposed portion adjacent to the common electrode of the corresponding unit substrate for electrical connection thereto through a conductive means, and a second exposed portion located away from the common electrode of the corresponding unit substrate for electrical connection to a power source.

The base board means may comprise a single base board or a plurality of separate base boards joined at least at one boundary. In the latter case, one of the unit substrates should preferably extend from one to another of the base boards across said one boundary, and the conductor film means corresponding to said one unit substrate comprises a pair of conductor films which are arranged on both sides of said one boundary for electrical connection to the common electrode of said one unit substrate.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
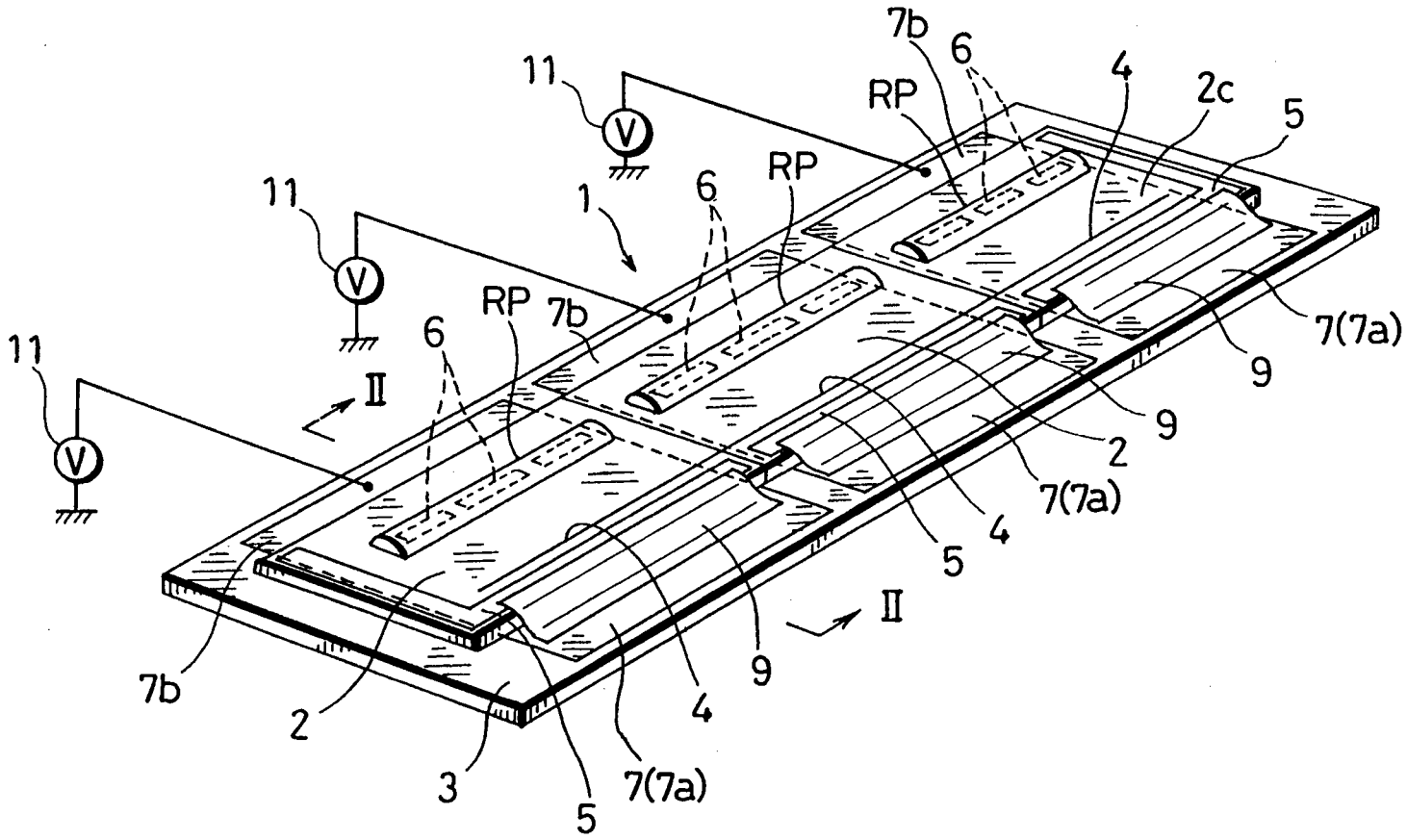
FIG. 1 is a perspective view showing a divisional-type thermal printhead according to the present invention.
Figure 2:
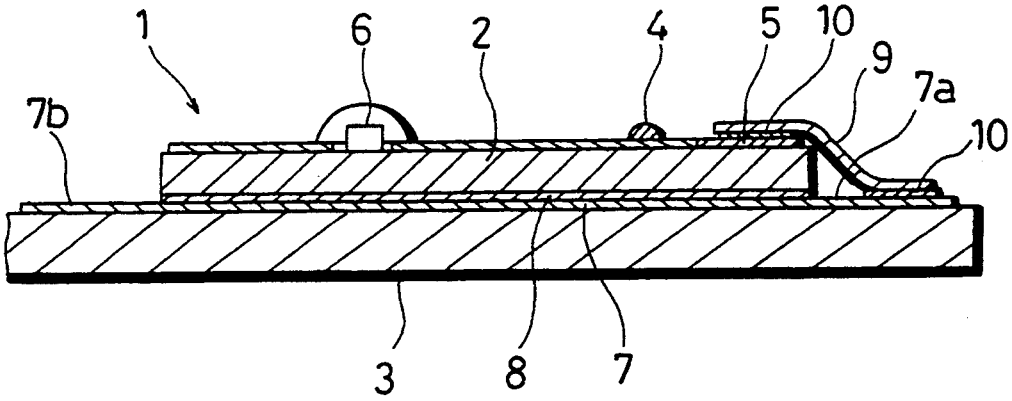
FIG. 2 is a sectional view taken along lines II—II in FIG. 1.

Referring first to FIGS. 1 and 2 of the accompanying drawings, there is shown a divisional-type thermal printhead 1 according to a first embodiment of the present invention. The printhead comprises a plurality of insulating unit substrates 2 mounted on a common insulating base board 3. There are three such substrates in the first embodiment, but a smaller or larger number of such substrates may be included.

Each of the unit substrates 2 carries a linear heating resistor 4 extending along a longitudinal edge of the unit substrate, and a common electrode 5 extending between the linear resistor 4 and the same longitudinal edge of the unit substrate. The common electrode has comb-like teeth (not shown) for electrical connection to the corresponding resistor.

As clearly appreciated in FIG. 1, the common electrodes 5 of the respective unit substrates 2 are electrically independent from each other. Despite the electrical independence between the respective common electrodes, the word "common"is used because each common electrode is used commonly for the entire length of the corresponding linear resistor 4.

Each of the unit substrates 2 also carries an array of drive ICs 6 enclosed in a protective resin package RP. The drive ICs are electrically connected to the corresponding linear resistor 4 through individual electrodes (not shown) arranged in staggered relation to the unillustrated comb-like teeth of the corresponding common electrode 5. By such an arrangement, the linear resistor 4 is divided into a multiplicity of heating dots which are selectively actuated by the drive ICs for performing an intended printing operation.

Though not illustrated, each of the unit substrates 2 further carries a conductor pattern between the array Of drive ICs 6 and a longitudinal edge of the unit substrate away from the linear resistor 4. The unillustrated conductor pattern is used for electrically connecting the drive ICs to an external circuit (not shown) which supplies various signals for controlling the drive ICs.

As seen in FIG. 1, the respective unit substrates 2 are arranged in series and in mutual end-to-end contact on the base board 3. As a result, the respective linear resistors 4 of the unit substrates 2 together form a substantially continuous line extending longitudinally of the base board 3.

The base board 3 is preferably made of the same insulating material as the respective unit substrates 2. For instance, if the unit substrates are made of ceramic, the base board should also be made of the same ceramic. This selection of the insulating material prevents thermal bending of the printhead which may result from a difference in thermal expansion between the base board and the unit substrates.

The base board 3 is formed with separate conductor films 7 (current passage widening films) of a sufficient width in corresponding relation to the respective unit substrates 2. The conductor films may be made of e.g. a silver paste or a silver-palladium paste deposited in different regions of the base board by a thick-film printing method or a thin-film printing method. Alternatively, the separate conductor films may be also made by first vapor-depositing a continuous metal film of e.g. silver or silver-palladium, and thereafter removing unnecessary portions of the continuous film by etching for example.

Each of the unit substrates 2 is attached on the corresponding conductor film 7 of the base board 3 by means of an insulating adhesive layer 8 for example. After attachment of the unit substrate, the conductor film 7 has first and second exposed portions *7a*, *7b* extending beyond the respective longitudinal edges of the unit substrate (see FIG. 2).

The common electrode 5 of each unit substrate 2 is electrically connected to the first exposed portion *7a* of the corresponding conductor film 7 by means of a conductive strip 9. The conductive strip may be made for example of a metal foil (e.g. copper foil) or a resin film (e.g. polyimide film) formed with a conductor coating. The conductive strip 9 may be attached to each of the common electrode 5 and the conductor film 7 via a layer 10 of conductive resin or solder. Apparently, the conductive strip 9 as a whole may be replaced by a body of conductive resin or solder.

In the illustrated embodiment, the second exposed portions *7b* of the respective conductor films 7 are electrically connected to different power sources 11, as shown in FIG. 1. Further, in actual assembly of the printhead 1, the base board 3 is mounted on a support plate (not shown) which is made of a metal (e.g. aluminum) to work as a heat sink.

With the arrangement described above, since the common electrode 5 is electrically connected to the corresponding conductor film 7 through the conductive strip 9, there will be virtually no voltage drop along the length of the corresponding linear resistor 4 due to the current passage widening function provided by the conductor film 7 and the conductor strip 9. Thus, all the heating dots of the linear resistor 4 are substantially equalized with respect to heat generation for thermal printing.

Further, the common electrodes 5 of the respective unit substrates 2 together with the associated conductor films 7 are electrically independent of each other. Thus, even if the resistors 4 of the respective unit substrates have different resistivity characteristics, such a resistivity difference can be compensated for by connecting the conductor films 7 to the different power sources 11 of different voltages. As a result, it is possible to equalize heat generation of the heating dots along the entire line provided by the series arrangement of the linear resistors 4 without equalizing the quality of the unit substrates 2 themselves. It should be appreciated that all of the conductor films 7 may be connected to a common power source (hence a constant voltage) if there is no difference in resistivity characteristics between the respective linear resistors 4.

Moreover, since the respective conductor films 7 are formed on the upper surface of the base board 3 which is inherently present in a divisional-type thermal printhead, there will be no or little increase in the total number of the required components and materials. Further, different portions of each conductor films 7 may be used for conveniently connecting to the corresponding power source 11 without inviting a voltage drop problem.

Figure 3:
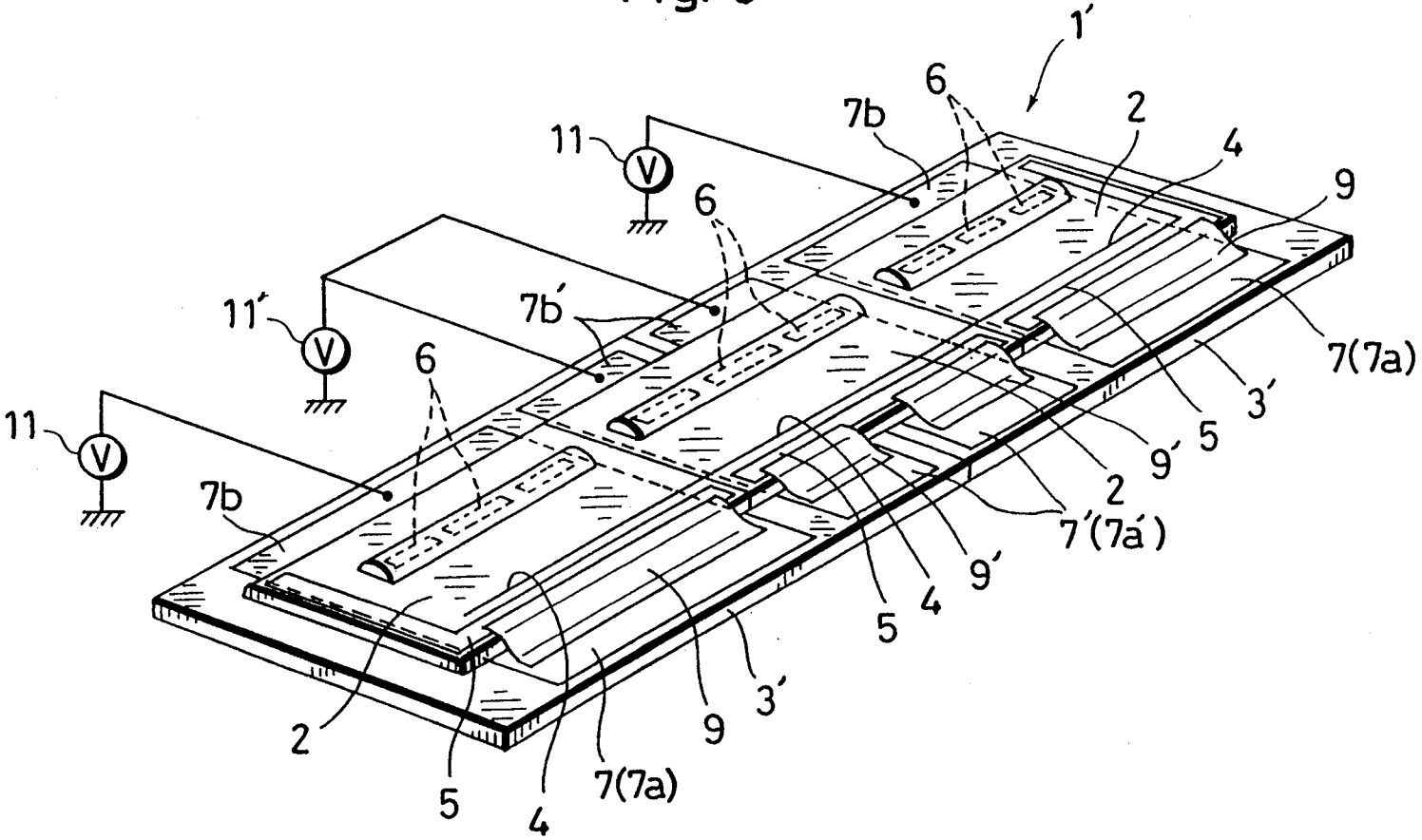
FIG. 3 is a perspective view showing another divisional-type thermal printhead according to the present invention.

FIG. 3 shows a divisional-type thermal printhead 1' according to a second embodiment of the present invention. The printhead of the second embodiment is similar to that of the first embodiment but differs therefrom only in the following points.

First, the printhead 1' incorporates a pair of insulating base boards 3' which are joined at a longitudinal center of a middle unit substrate 2. Such an arrangement is preferred when the required printing width of the printhead is too large to be realized by a single base board.

Secondly, the common electrode 5 of the middle unit substrate is associated with a pair of narrower conductor films 7' formed on both side of the boundary between the pair of base boards 3'. More specifically, the narrower conductor films 7' has their respective first exposed portions 7*a*' which are electrically connected to the same common electrode 5 separately through shorter conductive strips 9'. Further, the narrower conductor films 7'have their respective second exposed portions 7*b*' which are commonly connected to an associated power source 11'.

Obviously, the printhead 1' of the second embodiment enjoys substantially the same advantages as that of the first embodiment.

The present invention being thus described, it is obvious that the same may be modified in many ways. Such modifications are not to be regarded as a departure from the spirit and scope of the invention, and all such modifications as would be obvious to those skilled in the art are intended to be included within the scope of the following claims.

I claim:

1. A divisional-type thermal printhead comprising:

an insulating base board; and a plurality of unit substrates arranged in series on the base board, each unit substrate having a linear heating resistor extending straight along an edge of said each unit substrate and a common electrode extending between the heating resistor and said edge;

wherein each common electrode of the unit substrates is electrically independent of every other common electrode; and wherein the base board is formed with a plurality of conductor film extending under the unit substrates in corresponding relation thereto, each of the plurality of conductor film being electrically independent of the other conductor film but electrically connected to the common electrode of a respective one of said unit substrates.

2. The printhead according to claim 1, wherein each of the plurality of conductor film has an exposed portion adjacent to the common electrode of a corresponding unit substrate for electrical connection thereto through a conductive strip.

3. The printhead according to claim 2, wherein each of the plurality of conductor film has a second exposed portion located away from the common electrode of the corresponding unit substrate for electrical connection to a power source.

4. The printhead according to claim 1, wherein the base board comprises a plurality of separate base boards joined at least at one boundary, one of the unit substrates extending from one to another of the base boards across said one boundary, the conductor film corresponding to said one unit substrate comprising a pair of conductor films arranged on both sides of said one boundary, the pair of conductor films being electrically connected to the common electrode of said one unit substrate.

5. The printhead according to claim 4, wherein each of the paired conductor films has an exposed portion adjacent to the common electrode of said one unit substrate for electrical connection thereto through a conductive.

6. The printhead according to claim 5, wherein each of the paired conductor films has a second exposed portion located away from the common electrode of said one unit substrate for electrical connection to a power source which is common to both of the paired conductor films.

7. The printhead according to claim 1, wherein the base board strip and the unit substrates are made of a same ceramic material.

* * * * *